US006698360B2

(12) United States Patent
Park

(10) Patent No.: US 6,698,360 B2
(45) Date of Patent: Mar. 2, 2004

(54) NAIL CARING TABLE HAVING VACUUM PURIFIER

(75) Inventor: Jeung Hoon Park, Seoul (KR)

(73) Assignee: Beaunix Co., Ltd., Seoul (KR)

( * ) Notice: Subject to any disclaimer, the term of this patent is extended or adjusted under 35 U.S.C. 154(b) by 0 days.

(21) Appl. No.: 10/196,785

(22) Filed: Jul. 17, 2002

(65) Prior Publication Data

US 2003/0024442 A1 Feb. 6, 2003

(30) Foreign Application Priority Data

Aug. 3, 2001 (KR) ..... 2001-46915

(51) Int. Cl.[7] ..... A47B 37/00
(52) U.S. Cl. ..... 108/50.13
(58) Field of Search ..... 108/50.13, 50.18; 312/229, 236, 209, 196, 31; 132/73.5, 75

(56) References Cited

U.S. PATENT DOCUMENTS 4,280,519 A * 7/1981 Chapman ..... 132/73.5
4,329,002 A * 5/1982 Cowen et al. ..... 312/196
5,112,373 A * 5/1992 Pham ..... 96/142
5,336,128 A * 8/1994 Birdsong ..... 454/56
5,464,029 A * 11/1995 Rentz ..... 132/73.5
5,787,903 A * 8/1998 Blackshear ..... 132/73.5
5,795,219 A * 8/1998 Bloom ..... 454/49
5,816,906 A * 10/1998 Mai ..... 454/56
6,276,647 B1 * 8/2001 Stopper ..... 132/73

FOREIGN PATENT DOCUMENTS

GB 2083345 * 3/1982

* cited by examiner

*Primary Examiner*—Jose V. Chen
(74) *Attorney, Agent, or Firm*—Ladas & Parry

(57) ABSTRACT

A table with a work board for nail care by a worker on a generally opposite customer is in combination with a suction member. The suction member has a hollow space, a pair of exterior surface portions on one side for supporting lower portions of a customer's arms when the suction member is on the work board of the table and suction holes into the hollow space from an adjacent side of the suction member to be near the customer's hands when the customer's arms are supported on the surface portions. A suction purification apparatus has a flow pipe connected with the hollow space of the suction member for purifying air sucked through the suction holes, hollow space and flow pipe by contacting the air with water.

4 Claims, 5 Drawing Sheets

NAIL CARING TABLE HAVING VACUUM PURIFIER

BACKGROUND OF THE INVENTION

1. Field of the Invention

The present invention relates to a nail caring table, and in particular to a nail caring table having a vacuum purifier in which a customer cap keep a comfortable posture when a customer's nail is cared or an artificial nail is attached to a customer's nail or in which it is possible to suck a waste and bad smell which occur when caring a customer's nail and attaching an artificial nail to a customer's nail for thereby more effectively cleaning the above.

2. Description of the Background Art

Recently, as a beauty-related industry advances, people has a big attention on a nail caring. A long and colored beautiful nail is recognized as increasing the beauty of a woman. Modern women spend a lot time and effort for caring her nails.

Generally, an artificial nail is formed in a certain shape and is formed of a synthetic resin, etc. The user applies an adhesive to a natural nail and attaches a commercially available artificial nail to a natural nail. Thereafter, the user reshapes her nails based on her taste.

However, it is very difficult to attach an artificial nail to her natural nail for herself. In addition, even if the user attaches an artificial nail to her natural nail for herself, the artificial nail may not be properly attached, so that an outer appearance of the nail may be damaged.

Due to the above problems, the user uses a nail caring shop in which a customer's nail is effectively cared.

The above nail shop has a nail caring table for thereby providing a customer with a comfort when caring the customer's nails. In addition, the nail caring table includes a suction apparatus which is capable of removing dusts which occur when caring the customer's nails and a bad smell which occurs from an adhesive when attaching an artificial nail to a customer's natural nail.

The conventional nail caring table will be described as follows.

FIG. 1A is a perspective view illustrating a conventional nail caring table. FIG. 1B is a front view illustrating a conventional nail caring table.

As shown therein, a nail caring table 10 includes a board 11 which includes one surface in which a customer who wants an artificial nail attachment or a nail caring service and a worker who attaches an artificial nail and cares a customer's nail sit opposite each other, and the other opened surface which is arranged opposite to the above one surface, a suction portion 13 having a net 12 through which dusts occurring when caring an artificial nail after a worker attaches an artificial nail to a customer's natural nail and a bad smell occurring when attaching an adhesive are sucked, and a suction apparatus 14 which purifies air and dusts which are sucked through the suction portion 13.

However, in the above conventional nail caring table 10, since a certain paper scrap or thin cloth is provided on an upper surface of the net 12 formed in the suction portion 13 for preventing a piece of natural nail or a piece of artificial nail from flowing in except for air or dusts when a worker attaches an artificial nail to a customer's natural nail, a suction force of the suction portion 13 is decreased. In addition, an adhesive applied on a customer's natural nail for attaching an artificial nail to a customer's nail by a worker is formed of a high volatility adhesive for thereby quickly attaching an artificial nail. Therefore, a bad smell is quickly spread from an adhesive when the adhesive is applied. Therefore, the suction portion 13 provided below the hands of the customer and worker is not capable of efficiently sucking the above bad smell. In addition, since the suction apparatus 14 provided for sucking the dusts and air is installed in a lower surface of the board 11, the noise and vibrations of the suction apparatus 13 may be directly transferred to the customer and worker.

SUMMARY OF THE INVENTION

Accordingly, it is an object of the present invention to provide a nail caring table having a vacuum purifier which overcomes the problems encountered in the conventional art.

It is another object of the present invention to provide a nail caring table having a vacuum purifier which is capable of effectively sucking dusts and bad smell which occur when a worker attaches an artificial nail to a customer's nail by forming a suction port in the side of a customer's hand and independently installing a suction apparatus for thereby sucking dusts and bad smell irrespective of a piece of nail.

To achieve the above objects, there is provided a nail caring table having a vacuum purifier which includes a table body which includes a plate-shaped work board, a drawer box provided in one side of a lower portion of the work board, supporting one side of the work board and having a plurality of drawers for receiving various nail caring utilities and tools therein, and a leg portion which is provided in the other side of a lower portion of the work board for thereby supporting the other side of the work board, a suction portion which is formed of a synthetic resin material and includes a certain space formed therein, a pair of arm supporting surfaces for supporting a lower portion of a customer's arm and a plurality of suction holes which are formed in a side of a customer's hand near the arm supporting surface and suck dusts which occur when attaching an artificial nail and a bad smell of an adhesive, wherein the suction portion is provided on an upper surface of the work board, and a suction purification apparatus which includes a flow pipe connected with a space portion of the suction portion for thereby purifying the air sucked through the flow pipe by contacting the air with water.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The nail caring table having a vacuum purifier according to the present invention will be described with reference to the accompanying drawings.

The terminologies used in the descriptions of the present invention are chosen based on the functions of corresponding elements of the present invention. The above terminologies may differ based on the intention or usage of the technicians who work in the field of the invention. Therefore, the terminologies used in the descriptions of the present invention are not committed to limit the technical elements of the present invention.

Figure 1A:
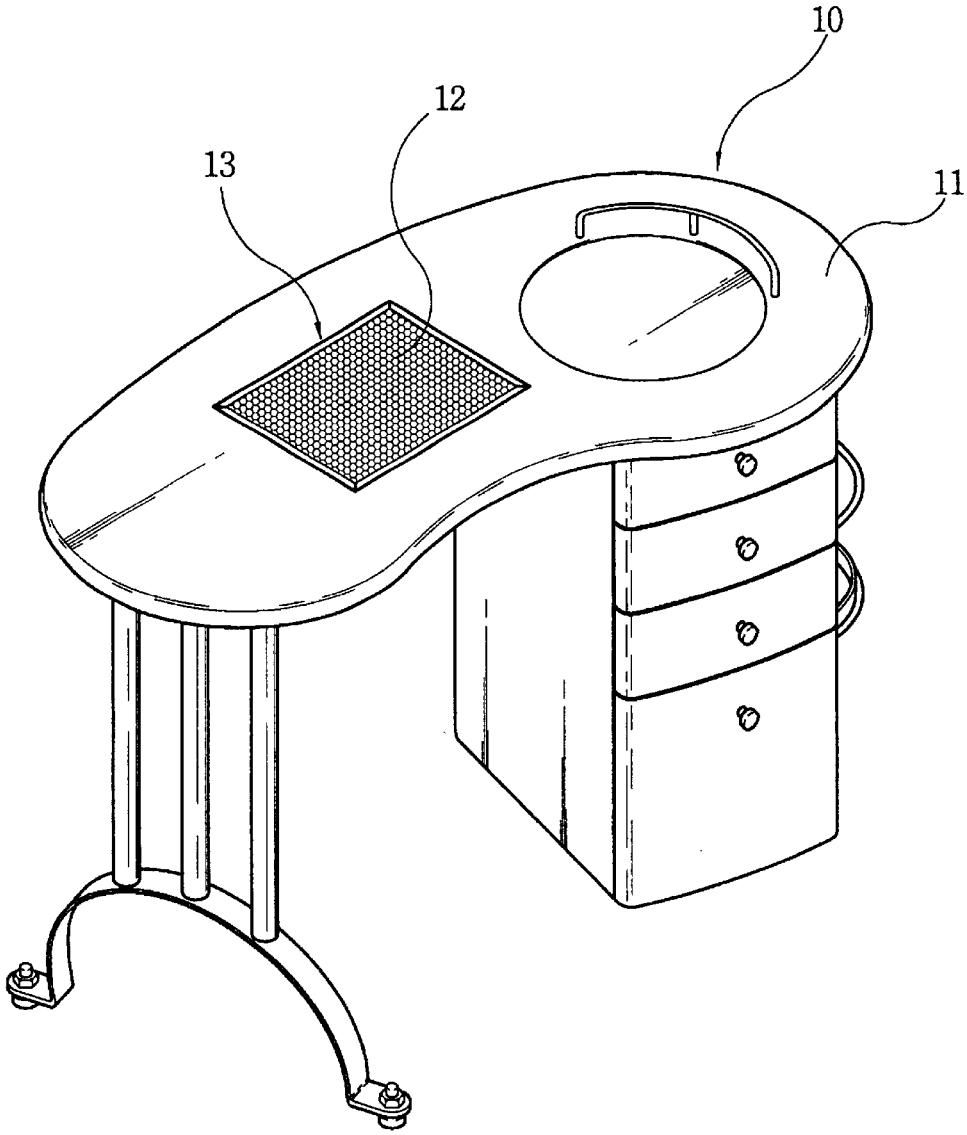
FIG. 1A is a perspective view illustrating a conventional nail caring table.
Figure 1B:
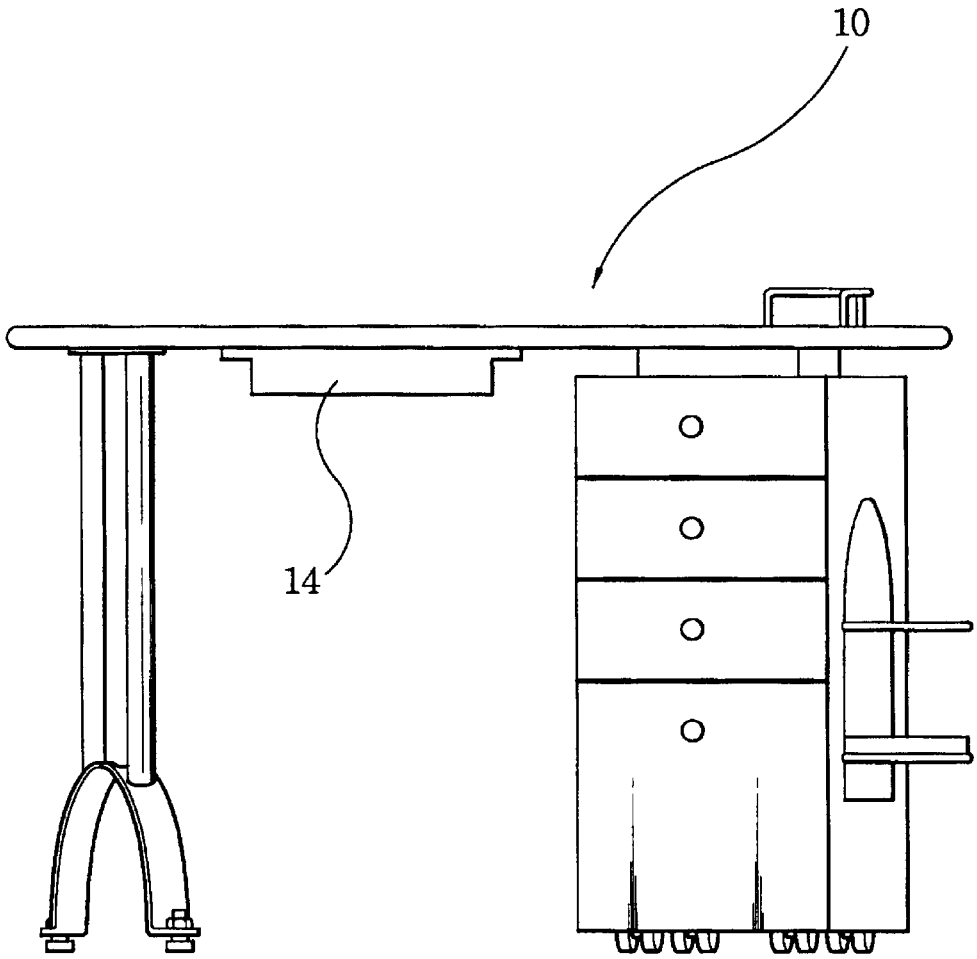
FIG. 1B is a front view illustrating a conventional nail caring table.
Figure 2:
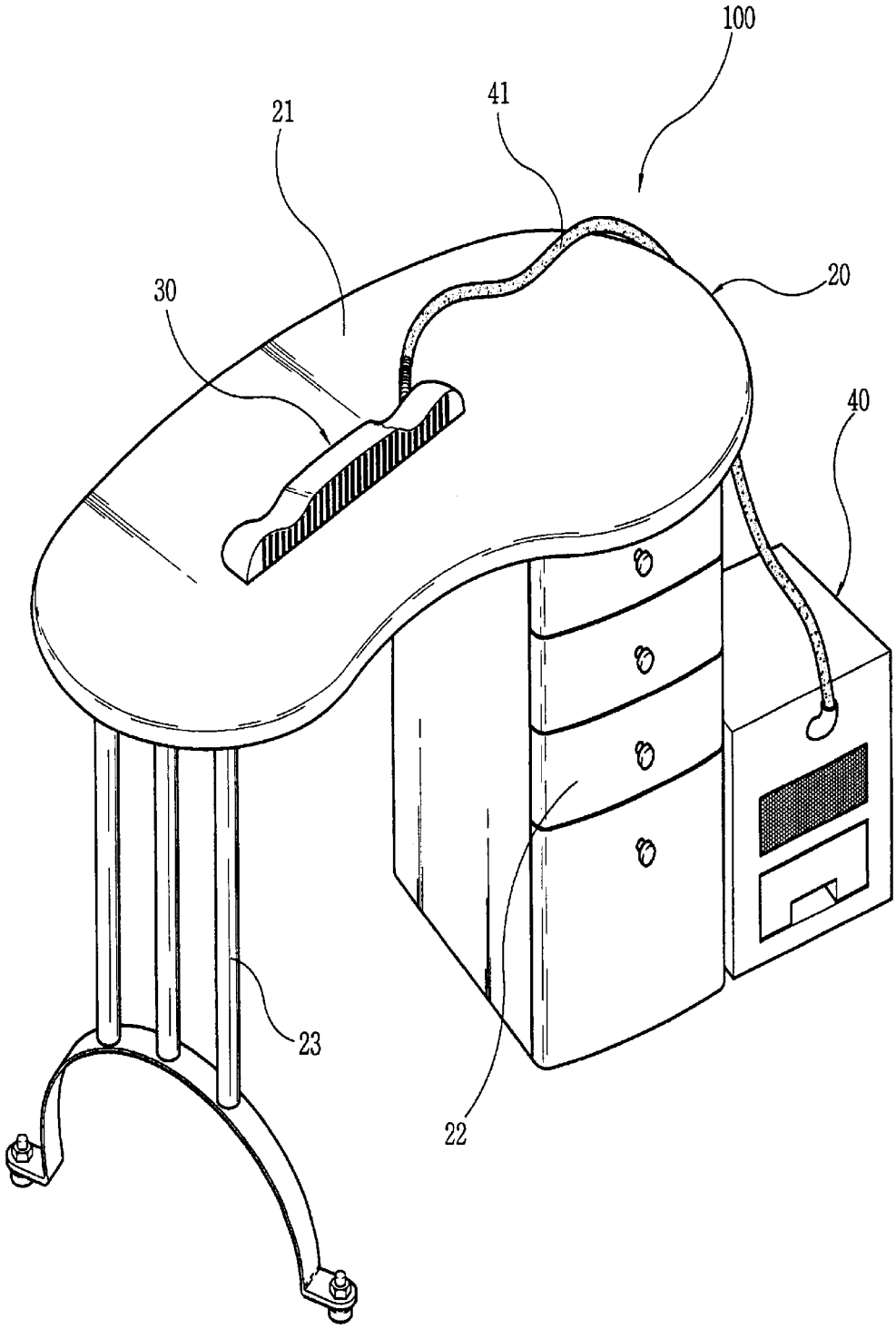
FIG. 2 is a perspective view illustrating a nail caring table having a vacuum purifier according to the present invention.
Figure 3:
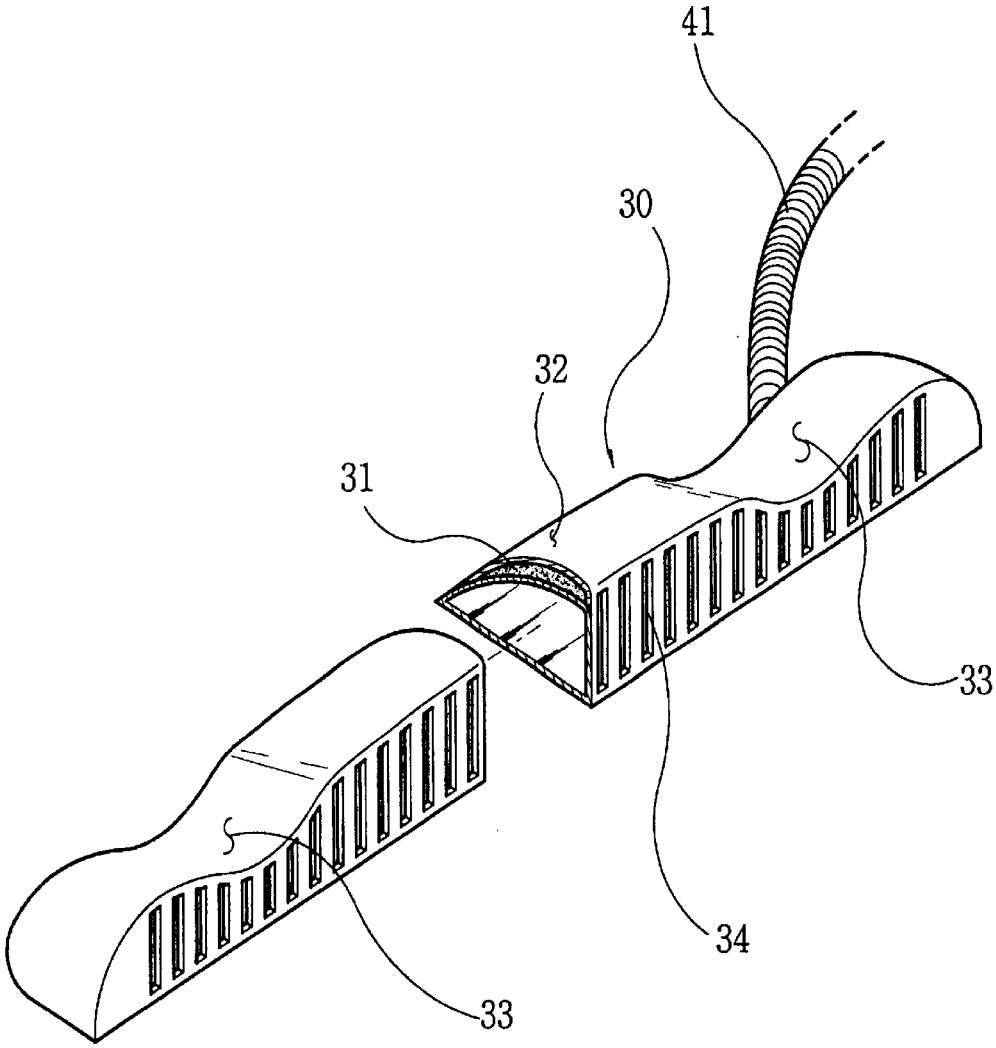
FIG. 3 is a partial cross-sectional perspective view illustrating a suction portion of a nail caring table having a vacuum purifier according to the present invention.
Figure 4:
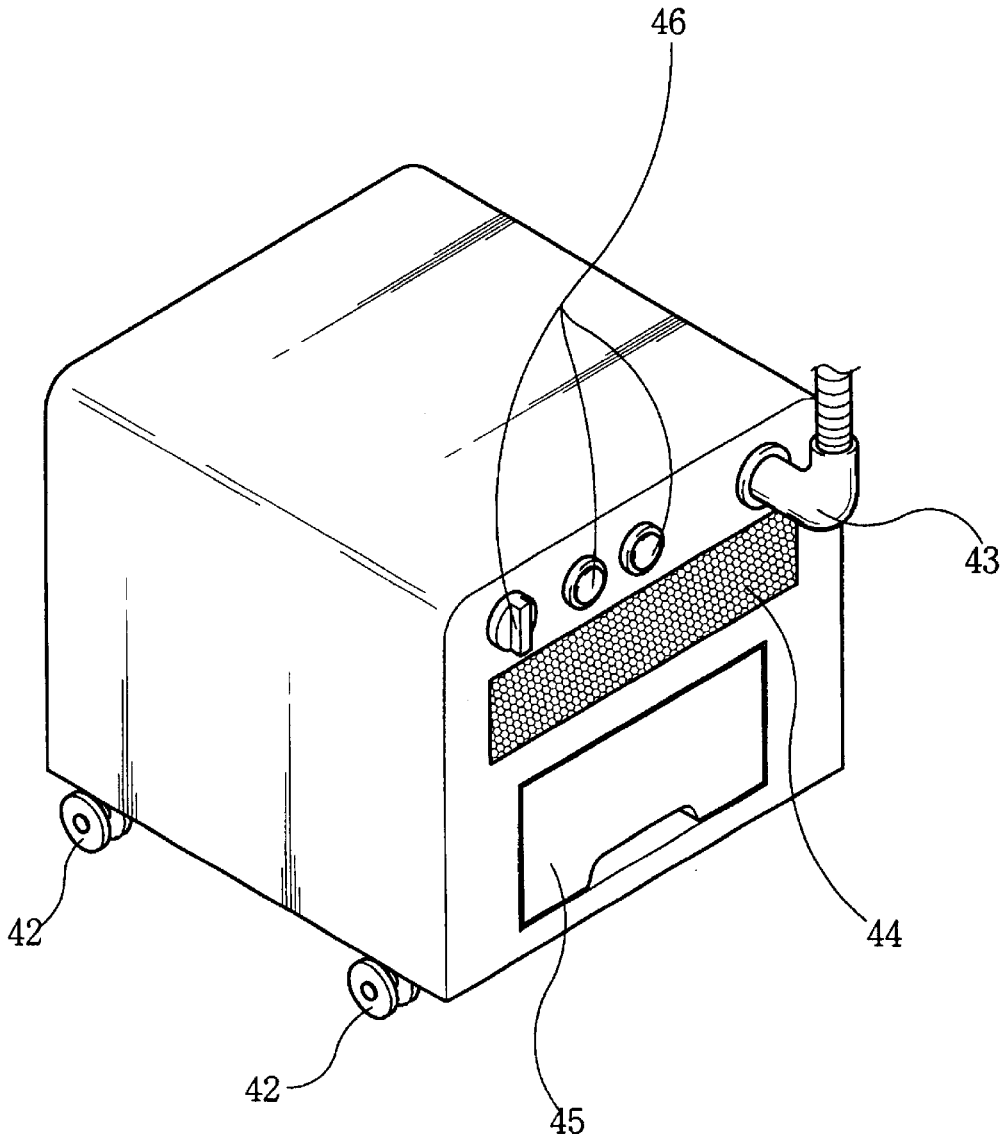
FIG. 4 is a perspective view illustrating a suction purifier installed in a nail caring table having a vacuum purifier according to the present invention.

FIG. 2 is a perspective view illustrating a nail caring table having a vacuum purifier according to the present invention. FIG. 3 is a partial cross-sectional perspective view illustrating a suction portion of a nail caring table having a vacuum purifier according to the present invention. FIG. 4 is a perspective view illustrating a suction purifier installed in a nail caring table having a vacuum purifier according to the present invention.

As shown therein, a nail caring table 100 having a vacuum purifier according to the present invention includes a table body 20 in which a customer and a worker who cares a customer's nail sit opposite from each other, a suction portion 30 which is provided on an upper surface of the table body 20 for thereby supporting a customer's arm and sucking a dust which occurs when attaching an artificial nail to a customer's natural nail and a bad smell of an adhesive, and a suction purification apparatus 40 which is connected with the suction portion 30 for thereby providing a suction force to the suction portion 30 and purifying a dust and bad smell of an adhesive.

The table body 20 includes a work board 21 provided on an upper portion for thereby attaching an artificial nail to a customer's natural nail thereon, a drawer box 22 which is provided one side a lower portion of the work board 21 and supports one side of the work board 21 and has a plurality of drawers in which various nail caring utilities and tools are inserted, and a leg portion 23 which is provided in the other side of a lower portion of the work board 21 for supporting the other sides of the work board 21.

The suction portion 30 is formed of a synthetic resin material and includes a certain space portion therein and is formed in a streamline shape and includes an elastic sponge capable of supporting a lower portion of a customer's arm when a worker attaches an artificial nail to a customer's natural nail for thereby decreasing a worker's fatigue, and a pair of arm support portions 33 which are formed of an artificial leather and surround an outer portion of the sponge 31.

In addition, a plurality of slit shaped suction holes 34 are formed in a surface near the arm support portion 33 for sucking dusts of a nail and artificial nail which occur when caring the customer's nail by a worker and attaching an artificial nail to a customer's natural nail and sucking a bad smell which occurs from an adhesive used for attaching an artificial nail to a natural nail.

In addition, a flow pipe 41 has a certain diameter and is connected with a space portion formed in the interior of the suction portion 30 and is connected with the suction purification apparatus 40 and transfers a suction force of the suction purification apparatus 40 to the suction portion 30.

The suction purification apparatus 40 is formed in a square box shape and includes a plurality of wheel members 42 provided in a lower portion of the same, so that the suction purification apparatus 40 is movable, and includes a wet type suction purification apparatus capable of purifying air by spraying water. In addition, there are provided a connection portion 43 connected with the flow pipe 41 connected to the suction portion 30, a suction fan(not shown) for forming a vacuum state suction force in the suction portion 30, a purification portion(not shown) for purifying air from the suction portion 30 by contacting the same with water, a discharging portion 44 for discharging air purified based on the contact with water in the purifying portion, and a water tank 45 for storing water used for purifying the air from the purifying portion. Here, the water tank 45 is formed in a drawer shape for thereby being drawn to the outside of the suction purification apparatus. A plurality of switches 46 are provided in one side for controlling the suction purification apparatus.

Therefore, in the nail caring table according to the present invention, a customer who wants to attach an artificial and a worker can work in a more comfortable posture. In addition, it is possible to purify dusts which occur when attaching an artificial nail and a bad smell which occurs from an adhesive.

In the nail caring table having a vacuum suction portion according to the present invention, a suction portion is provided in one side of a customer's finger for thereby sucking dusts of an artificial nail which occur when attaching an artificial nail to a customer's natural nail by a worker and a bad smell which occurs from an adhesive used for attaching an artificial nail. Therefore, it is possible to efficiently suck a bad smell which occurs from an adhesive used for attaching an artificial nail and dusts of an artificial nail which occurs after an artificial nail is attached. In addition, the suction apparatus capable of sucking dusts and a bad smell is installed separately from the table, so that the noise and vibration are not directly transferred to the customer and worker, whereby it is possible to implement a good working environment.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In combination with a table having a work board for nail care by a worker on a generally opposite customer, the improvements comprising:

a suction member having a hollow space therein, a pair of exterior surface portions on one side for supporting lower portions of a customer's arms when the suction member is on the work board of the table, and suction holes into the hollow space from an adjacent side of the suction member for being near the customer's hands when the customer's arms are supported on the surface portions; and a suction purification apparatus having a flow pipe connected with the hollow space of the suction member for purifying air sucked through the suction holes, hollow space and flow pipe by contacting the air with water.

2. The table of claim 1, wherein said suction holes each are formed in a slit shape.

3. The table of claim 1, wherein said suction purification apparatus is formed in a square box shape and includes a plurality of wheel members installed in a lower portion of the same for thereby being movable and is formed of a wet type suction purification apparatus capable of purifying an air by spraying water and includes a connection portion connected with a flow pipe connected to the suction portion, a suction fan which forms a vacuum state suction force in the suction portion, a purification portion which purifies the air from the suction portion by contacting the air with water, a discharging portion which discharges the air in contact with the water in the purification portion, and a water tank which stores the water used for purifying the air in the purification portion.

4. A nail caring table of a type in which the nail designer and patron sit at opposite sides of the table in face-to-face relation, the nail caring table comprising, a table body which includes a plate-shaped work board, a drawer box provided in one side of a lower portion of the work board, supporting one side of the work board and having a plurality of drawers for receiving various nail caring utilities and tools therein, and a leg portion which is provided in the other side of a lower portion of the work board for thereby supporting the other side of the work board;

a streamline-shaped suction portion which is provided on the work board and inclined upwardly at an acute angle to the work board for supporting the forearm of the patron in an upwardly inclined position and extends downwardly from the upper edge of the same and includes a pair of arm supporting surfaces being concaved for supporting the forearm of the patron in a comfortable condition, a plurality of suction holes formed on said extended portion from the upper edge of the same for sucking bad smells or by-products caused during nail caring; and a suction purification apparatus which includes a flow pipe connected with a space portion of the suction portion for thereby purifying the air sucked through the flow pipe by contacting the air with water.

* * * * *